US012129842B2

(12) United States Patent
In

(10) Patent No.: US 12,129,842 B2
(45) Date of Patent: Oct. 29, 2024

(54) RECIPROCAL COMPRESSOR AND REFRIGERATOR INCLUDING THE SAME

(71) Applicant: SAMSUNG ELECTRONICS CO., LTD., Suwon-si (KR)

(72) Inventor: Jinsu In, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/947,259

(22) Filed: Sep. 19, 2022

(65) Prior Publication Data

US 2023/0220841 A1 Jul. 13, 2023

Related U.S. Application Data

(63) Continuation of application No. PCT/KR2022/013652, filed on Sep. 13, 2022.

(30) Foreign Application Priority Data

Jan. 10, 2022 (KR) ..... 10-2022-0003614

(51) Int. Cl.
*F04B 39/00* (2006.01)
*F04B 39/12* (2006.01)

(52) U.S. Cl.
CPC ..... *F04B 39/0005* (2013.01); *F04B 39/125* (2013.01)

(58) Field of Classification Search
CPC ..... F04B 49/16; F04B 39/125; F04B 39/0005
See application file for complete search history.

(56) References Cited

U.S. PATENT DOCUMENTS 5,525,045 A * 6/1996 Jang ..... F04B 49/03 417/284
9,709,306 B2 7/2017 Hyun et al.
2002/0043153 A1 4/2002 An et al.
2011/0277877 A1* 11/2011 Stehle ..... B29C 73/166 141/38

(Continued)

FOREIGN PATENT DOCUMENTS

JP 10-9123 1/1998
JP 2003-278658 10/2003
JP 5617402 B2 11/2014

(Continued)

OTHER PUBLICATIONS

PCT/ISA/220 dated Dec. 22, 2022 in International Patent Application No.: PCT/KR2022/013652 (11 pages).

*Primary Examiner* — Abiy Teka
(74) *Attorney, Agent, or Firm* — STAAS & HALSEY LLP

(57) ABSTRACT

A reciprocal compressor includes a cylinder, a piston inside the cylinder and including an upper wall constituting a compression chamber and a lateral wall formed to extend from the upper wall, an elastic cover provided so that an outer surface of the upper wall of the piston is between the piston and the elastic cover, and a cam mechanism configured to deform the elastic cover into a first state in which the elastic cover is apart from the upper wall of the piston to reduce a volume of the compression chamber and to restore the elastic cover into a second state in which the elastic cover is closer to the upper wall of the piston than in the first state while the piston is moved to a top dead center and a bottom dead center.

16 Claims, 11 Drawing Sheets

(56) References Cited

U.S. PATENT DOCUMENTS

| | | | |
|---|---|---|---|
| 2012/0014821 | A1 | 1/2012 | Hikichi et al. |
| 2014/0341763 | A1 | 11/2014 | Kobayashi et al. |

FOREIGN PATENT DOCUMENTS

| | | | |
|---|---|---|---|
| JP | 6010762 | B2 | 10/2016 |
| JP | 2021-181774 | A | 11/2021 |
| KR | 20-0122396 | | 8/1998 |
| KR | 10-2002-0029549 | | 4/2002 |
| KR | 10-0455200 | B1 | 11/2004 |
| KR | 10-2005-0101474 | | 10/2005 |
| KR | 10-1854953 | B1 | 5/2018 |
| KR | 10-1938713 | B1 | 1/2019 |

* cited by examiner

RECIPROCAL COMPRESSOR AND REFRIGERATOR INCLUDING THE SAME

CROSS-REFERENCE TO RELATED APPLICATION

This application is a continuation application, under 35 U.S.C. § 111(a), of international application No. PCT/KR2022/013652, filed on Sep. 13, 2022, which claims priority under 35 U. S. C. § 119 to Korean Patent Application No. 10-2022-0003614, filed on Jan. 10, 2022, the disclosures of which are incorporated herein by reference in their entirety.

BACKGROUND

Field

The disclosure relates to a reciprocal compressor and a refrigerator including the same.

Description of Related Art

Cooling systems such as a refrigerator, an air conditioner, etc. may include a compressor configured to compress a low-pressure refrigerant into a high-pressure refrigerant. A reciprocal compressor may compress a refrigerant by the reciprocating motion of a piston. When the piston moves from a top dead center to a bottom dead center, the refrigerant may be sucked into a compression chamber through a refrigerant inlet, and when the piston moves from the bottom dead center to the top dead center, the refrigerant may be compressed and discharged from the compression chamber through a refrigerant outlet. To avoid interference between the piston and a structure arranged in the cylinder, such as a valve, etc., when the piston is located in the top dead center, an upper wall of the piston may be spaced apart from an upper wall of the cylinder. A volume of the compression chamber when the piston is placed in the top dead center may be referred to as a clearance volume.

SUMMARY

A reciprocal compressor according to an embodiment of the disclosure may include a cylinder having a refrigerant inlet and a refrigerant outlet. A piston may be arranged inside the cylinder. The piston may include an upper wall constituting a compression chamber in the cylinder and include a lateral wall extending from the upper wall. An elastic cover may be provided so that the upper wall of the piston is between the piston and the elastic cover. A cam mechanism may deform the elastic cover into a first state in which the elastic cover is apart from the upper wall of the piston to reduce a volume of the compression chamber and to restore the elastic cover into a second state in which the elastic cover is closer to the upper wall of the piston than in the first state while the piston is moved to a top dead center and a bottom dead center.

A reciprocal compressor according to an embodiment of the disclosure may include a cylinder having a refrigerant inlet and a refrigerant outlet. A piston may be arranged inside the cylinder. An upper wall of the piston may be provided with an opening and a lateral wall formed to extend from the upper wall and form an internal space together with the upper wall. An elastic cover having elasticity may be provided outside the upper wall of the piston.

A refrigerator according to an embodiment of the disclosure may include a storage chamber, and a cooling device including the fore-mentioned reciprocal compressor and configured to cool the storage chamber.

BRIEF DESCRIPTION OF DRAWINGS

This disclosure may be readily understood by reference to the following detailed description and the accompanying drawings, in which reference numerals refer to structural elements.

DETAILED DESCRIPTION OF EXEMPLARY EMBODIMENTS

Figure 1:
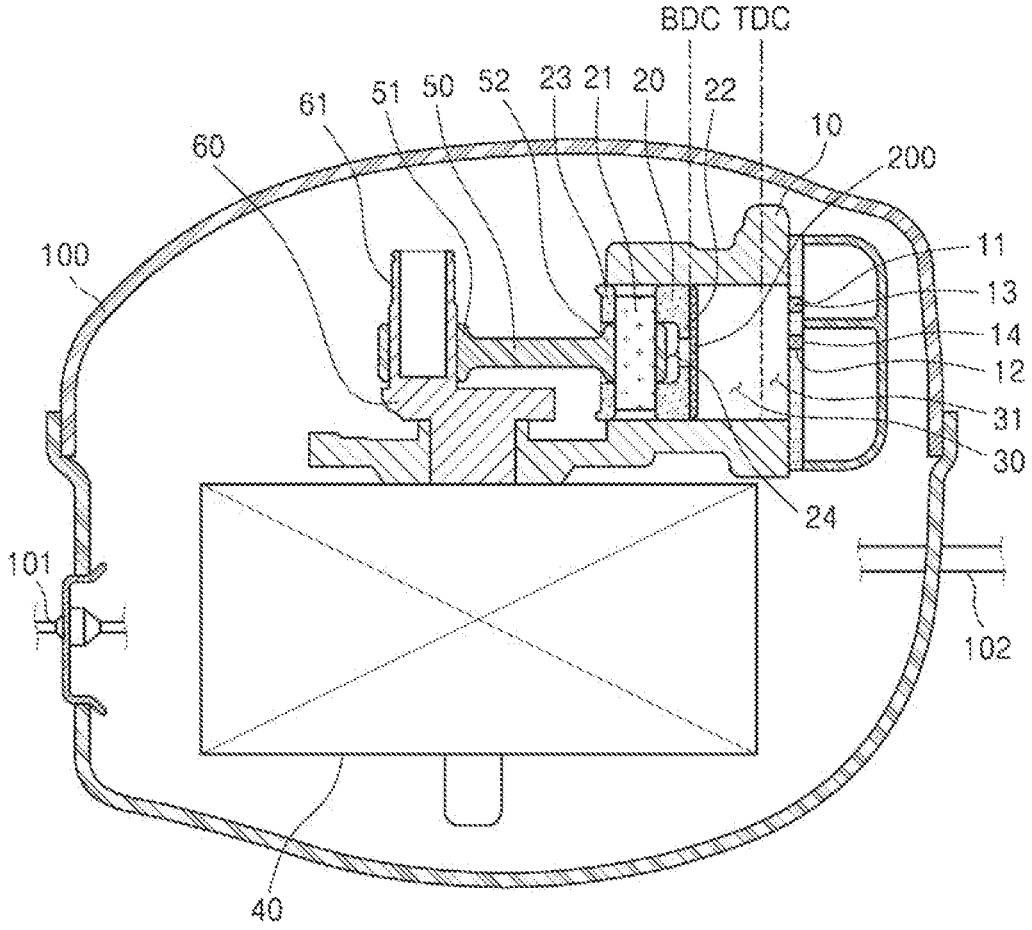
FIG. 1 is a schematic cross-sectional view of a reciprocal compressor according to an embodiment of the disclosure.

Throughout the disclosure, the expression "at least one of a, b or c" indicates only a, only b, only c, both a and b, both a and c, both b and c, all of a, b, and c, or variations thereof.

All terms including descriptive or technical terms which are used in the specification should be construed as having meanings that are obvious to one of ordinary skill in the art. However, the terms may have different meanings according to the intention of one of ordinary skill in the art, precedent cases, or the appearance of new technologies. Further, in certain cases, terms may be arbitrarily selected by the applicant, and in such cases, meanings of the terms will be described in detail in corresponding descriptions. Therefore, the terms used in the disclosure should not be interpreted based on only their names but have to be defined based on the meaning of the terms together with the descriptions throughout the specification. In the specification, when a portion "includes" or "comprises" an element, another element may be further included, rather than excluding the existence of the other element, unless otherwise described.

Hereinafter, embodiments of the disclosure will be described in detail with reference to the accompanying drawings so that a person with ordinary skill in the art may easily perform the disclosure. However, the disclosure may be implemented in various forms, and are not limited to the embodiments described herein. To clearly describe the disclosure, parts that are not associated with the description have been omitted from the drawings, and throughout the specification, identical reference numerals refer to identical parts. Hereinafter, embodiments of the disclosure will be described in detail with reference to the accompanying drawings.

As a clearance volume is not used as an effective suction volume in a reciprocal compressor, to increase volume efficiency of the reciprocal compressor, the clearance volume needs to be minimized. The disclosure provides a reciprocal compressor capable of reducing a clearance volume. The disclosure provides a reciprocal compressor with improved clearance volume. The disclosure provides a reciprocal compressor with improved durability.

According to a reciprocal compressor of the disclosure, by employing an elastic cover which is deformed into a state that reduces a volume of a compression chamber when a piston is placed in a top dead center, the volumetric efficiency of the compressor may be improved. By employing the elastic cover, the degradation of durability due to contact between an upper structure of the cylinder and the piston may be prevented or reduced.

Figure 2:
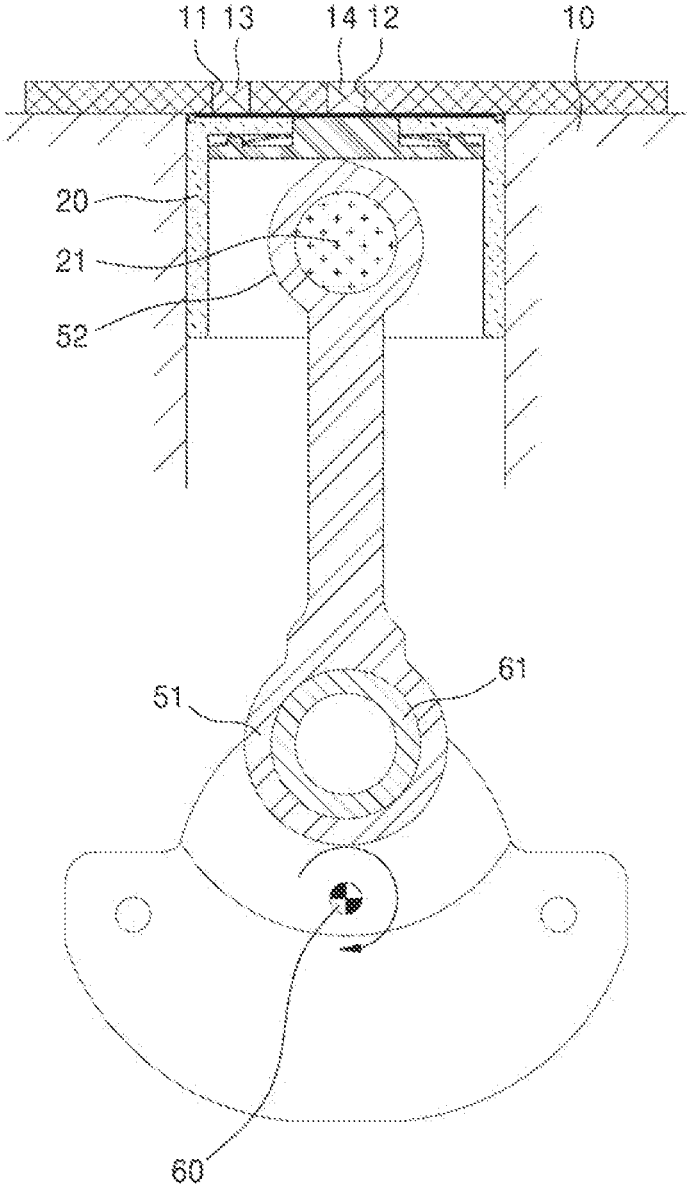
FIG. 2 is a diagram illustrating a state where a piston is placed in a top dead center according to an embodiment of the disclosure.
Figure 3:
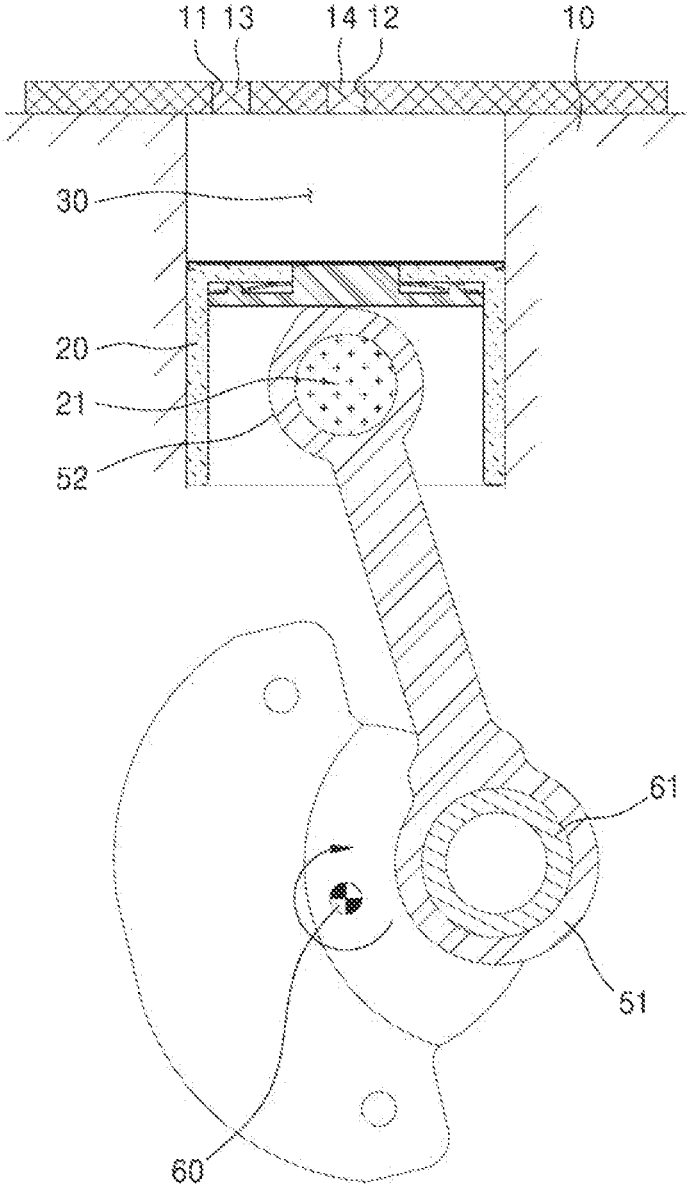
FIG. 3 is a diagram illustrating a state where a piston is placed in a bottom dead center according to an embodiment of the disclosure.

FIG. 1 is a schematic cross-sectional view of a reciprocal compressor according to an embodiment of the disclosure. FIG. 2 is a diagram illustrating a state where a piston 20 is placed in a top dead center TDC. FIG. 3 is a diagram illustrating a state where the piston 20 is placed in a bottom dead center BDC. With reference to FIGS. 1 to 3, a reciprocal compressor according to an embodiment of the disclosure may include a cylinder 10, the piston 20 reciprocating in the cylinder 10 to suck and compress a refrigerant, and a motor 40 enabling the reciprocation of the piston 20.

The cylinder 10 may provide a compression chamber 30. The cylinder 10 may include a refrigerant inlet 11 and a refrigerant outlet 12. The refrigerant inlet 11 and the refrigerant outlet 12 may include an inlet valve 13 and an outlet valve 14, respectively. The inlet valve 13 and the outlet valve 14 may open and close the refrigerant inlet 11 and the refrigerant outlet 12, respectively. The inlet valve 13 and the outlet valve 14 may be a check valve allowing a flow of refrigerant in one direction through the refrigerant inlet 11 and the refrigerant outlet 12. For example, the inlet valve 13 may allow a flow of refrigerant in an inflow direction in which the refrigerant flows into the compression chamber 30 through the refrigerant inlet 11. The outlet valve 14 may allow a flow of refrigerant in a discharge direction in which the refrigerant is discharged from the compression chamber 30 through the refrigerant outlet 12. The refrigerant may flow into a housing 100 through an inlet tube 101 and the inlet tube 101 may be connected with the refrigerant inlet 11. An outlet tube 102 may be connected with the refrigerant outlet 12, and the refrigerant may be discharged to the outside of the housing 100 through the outlet tube 102. In the compression process, when the piston 20 moves from the bottom dead center BDC to the top dead center TDC, a discharge flow rate of the refrigerant may be the highest at the center portion of the cylinder 10. In consideration of the foregoing, the refrigerant outlet 12 may be provided near the center portion of an upper wall of the cylinder 10.

The piston 20 may be arranged inside the cylinder 10 and form the compression chamber 30. The piston 20 may include an upper wall 22 forming the compression chamber 30 and a lateral wall 23 formed to extend from the upper wall 22. The piston 20 may be reciprocated between the top dead center TDC and the bottom dead center BDC by the motor 40. For example, the motor 40 may rotate a crankshaft 60. The piston 20 may be connected with the crankshaft 60 by a connecting rod 50. The crankshaft 60 may include an eccentric portion 61. A first end portion 51 of the connecting rod 50 may be rotatably connected with the eccentric portion 61. A second end portion 52 of the connecting rod 50 may be rotatably connected with the piston 20. For example, the second end portion 52 of the connecting rod 50 may be rotatably connected with the piston 20, with a piston pin 21 arranged therebetween. The rotation of the crankshaft 60 may be converted into the reciprocation of the connecting rod 50. Accordingly, when the motor 40 rotates, the piston 20 may reciprocate between the top dead center TDC and the bottom dead center BDC in the cylinder 10.

When the piston 20 moves from the top dead center TDC to the bottom dead center BDC, a volume of the compression chamber 30 may increase, and suction pressure may be generated inside the compression chamber 30. The refrigerant inlet 11 may be opened by the inlet valve 13, and the refrigerant outlet 12 may be closed by the outlet valve 14. The refrigerant introduced into the housing 100 through the inlet tube 101 may flow into the compression chamber 30 through the refrigerant inlet 11. When the piston 20 moves from the bottom dead center BDC to the top dead center TDC, the volume of the compression chamber 30 may decrease, and discharge pressure may be generated inside the compression chamber 30. The refrigerant inlet 11 may be closed by the inlet valve 13, and the refrigerant outlet 12 may be opened by the outlet valve 14. The refrigerant is compressed and discharged from the compression chamber 30 through the refrigerant outlet 12, and to the outside of the housing 100 through the outlet tube 102.

When the piston 20 is located at the top dead center TDC, the volume of the compression chamber 30 may be 0. However, to avoid interference between the piston 20 and an upper structure of the cylinder 10, e.g., the inlet valve 13 or the outlet valve 14, even when the piston 20 is located at the top dead center TDC, the volume of the compression chamber 30 may not be 0. The volume of the compression chamber 30 when the piston 20 is located at the top dead center TDC may be referred to as a clearance volume 31. The clearance volume 31 may not be used as an effective refrigerant suction volume. Accordingly, the existence of the clearance volume 31 may be a factor decreasing the volume efficiency of the reciprocal compressor. The less the clearance volume 31 is, the greater the volume efficiency of the reciprocal compressor may increase. The size of the clearance volume 31 may vary according to the machining accuracy of members constituting the reciprocal compressor; however, there may be a limit in reducing the clearance volume 31 due to a manufacturing error, assembly error, etc. of the members constituting the reciprocal compressor.

The reciprocal compressor according to the disclosure employs a structure minimizing the clearance volume 31 and durability degradation due to the interference between the piston 20 and the upper structure of the cylinder 10. The reciprocal compressor of the disclosure may include an elastic cover 200 arranged outside of the upper wall 22 of the piston 20 and a cam mechanism 300 (FIG. 4) deforming the elastic cover 200 into a first state where the elastic cover 200 is spaced apart from the upper wall 22 and the volume of the compression chamber 30 is reduced, and restoring the elastic cover 200 into a second state where the elastic cover 200 is closer to the upper wall 22 of the piston 20 than in the first state according to movement of the piston 20 to the top dead center TDC and the bottom dead center BDC.

Figure 4:
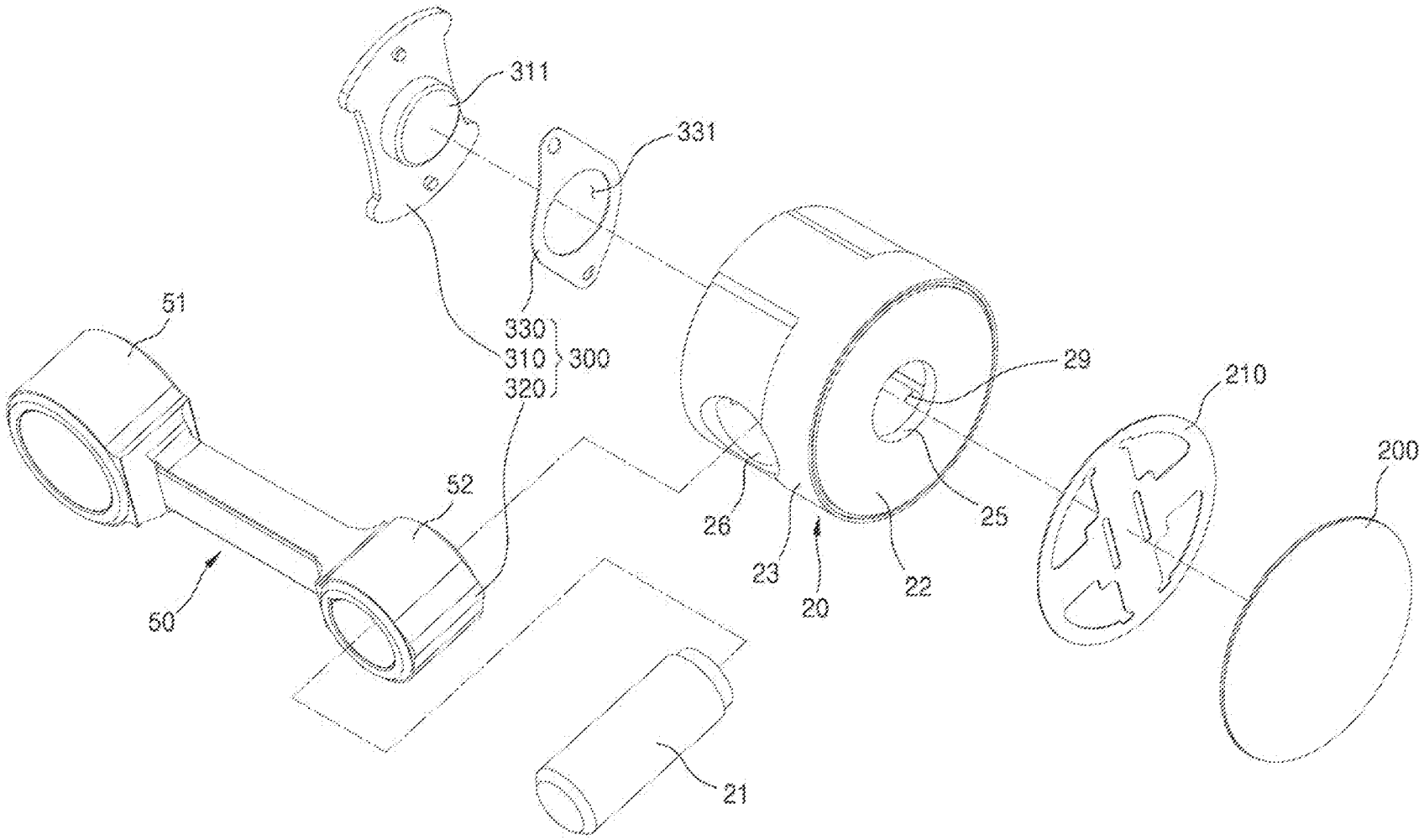
FIG. 4 is an exploded perspective view of an example of an elastic cover and a cam mechanism according to an embodiment of the disclosure.
Figure 5:
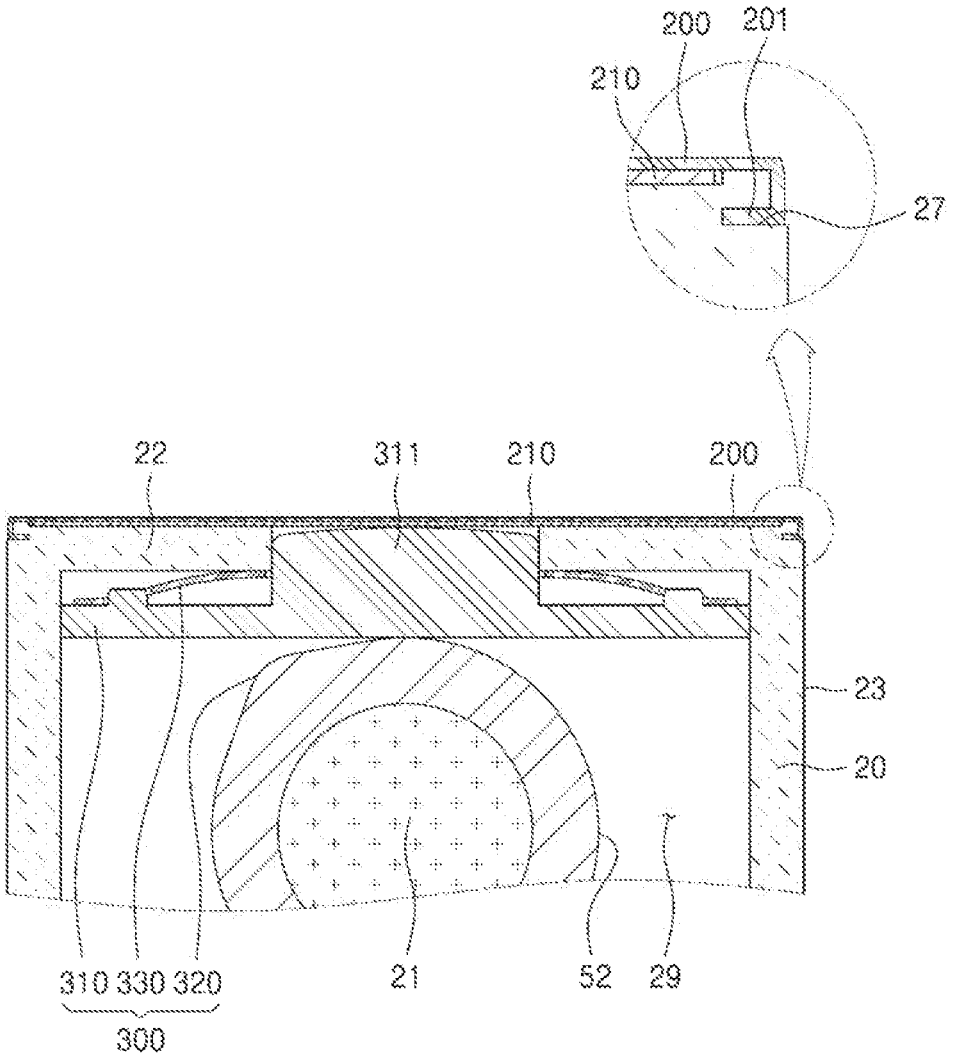
FIG. 5 is a cross-sectional view of an example of an elastic cover and a cam mechanism and illustrates the elastic cover in a second state according to an embodiment of the disclosure.
Figure 6:
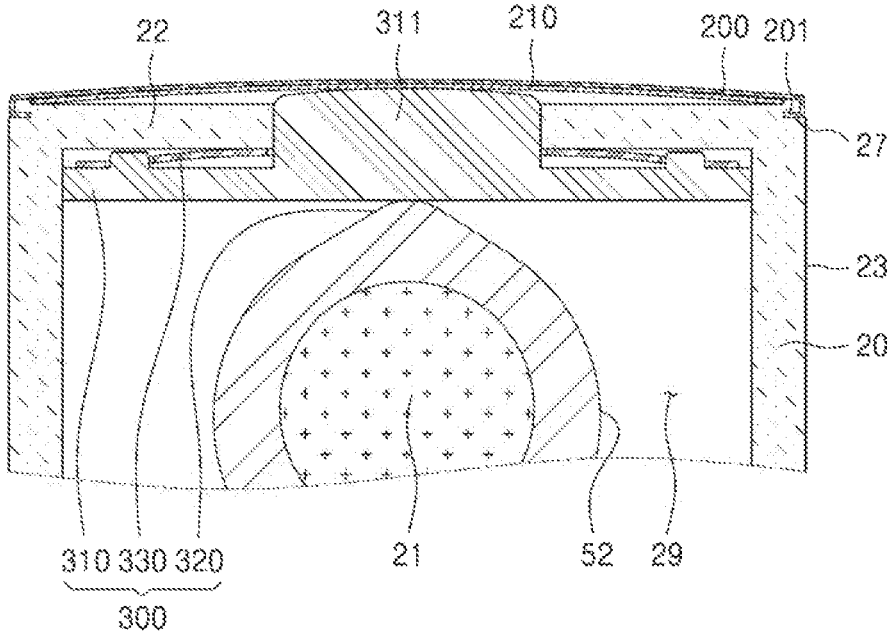
FIG. 6 is a cross-sectional view of an example of an elastic cover and a cam mechanism and illustrates the elastic cover in a first state according to an embodiment of the disclosure.

FIG. 4 is an exploded perspective view of an example of the elastic cover 200 and the cam mechanism 300. FIGS. 5 and 6 cross-sectional views showing an example of the elastic cover 200 and the cam mechanism 300. FIG. 5 illustrates the elastic cover 200 in the second state, and FIG. 6 illustrates the elastic cover 200 in the first state. With reference to FIGS. 4 to 6, the reciprocal compressor according to an embodiment of the disclosure may include the elastic cover 200. The elastic cover 200 may be arranged outside, for example, on the outer surface of the upper wall 22 of the piston 20. The elastic cover 200 may be combined with the piston 20 in various manners. For example, a coupling groove 27 in a ring shape may be provided on the lateral wall 23 of the piston 20. The coupling groove 27 in a ring shape may be recessed into the lateral wall 23 of the piston 20. A coupling protrusion 201 in a ring shape to be insertable elastically into the coupling groove 27 may be provided on an outer edge of the elastic cover 200. For example, the coupling protrusion 201 may be in an "L" shape, and the coupling groove 27 may have a shape complementary to that of the coupling protrusion 201. According to such configuration, the elastic cover 200 may be coupled to the piston 20 without using a fastening member, such as a screw, etc.

The elastic cover 200 may be in the first state where the elastic cover 200 is spaced apart from the upper wall 22 of the piston 20 as illustrated in FIG. 6, and in the second state where the elastic cover 200 is adjacent to the upper wall 22 of the piston 20 as illustrated in FIG. 5. The first state may be a state minimizing the volume of the compression chamber 30. The elastic cover 200 may have a plate shape corresponding to the upper wall 22, for example, a circular plate shape. The elastic cover 200 may be formed of a material which has elasticity and is deformable into the first state and the second state. The elastic cover 200 may be elastically deformed into the first state from the second state by an external force, and when the external force is removed, the elastic cover 200 may be restored to the second state from the first state. The elastic cover 200 may be formed of, for example, synthetic resin having elasticity. For example, the elastic cover 200 may be formed of teflon (polytetrafluoroetylene) resin.

The cam mechanism 300 may elastically deform the elastic cover 200 into the first state where the elastic cover 200 is spaced apart from the upper wall 22 and the compression chamber 30 is reduced when the piston 20 moves from the bottom dead center BDC to the top dead center TDC. The cam mechanism 300 may allow the elastic cover 200 to be elastically restored into the second state where the elastic cover 200 is placed close to the upper wall 22 when the piston 20 moves from the top dead center TDC to the bottom dead center BDC. The upper wall 22 and the lateral wall 23 of the piston 20 may form an internal space 29. The cam mechanism 300 may be arranged in the internal space 29 of the piston 20. The cam mechanism 300 may deform the elastic cover 200 through an opening 25 provided in the upper wall 22 of the piston 20. In this manner, a compact reciprocal compressor may be implemented.

For example, the cam mechanism 300 may be driven by the connecting rod 50. The connecting rod 50 may reciprocate according to the rotation of the crankshaft 60, and the second end portion 52 of the connecting rod 50 may pivot around the piston pin 21. The cam mechanism 300 may be driven by the pivoting of the second end portion 52 of the connecting rod 50. In this manner, the cam mechanism 300 may be driven by using the driving power of the motor 40 without employing a separate actuator.

For example, the cam mechanism 300 may include an operating member 310 and a cam protrusion 320. The operating member 310 may be arranged inside the internal space 29 of the piston 20. The operating member 310 may be arranged in the internal space 29 such that the operating member 310 may be moved to a first position and a second position in a reciprocation direction of the piston 20 along the lateral wall 23. The operating member 310 may include a protruding portion 311 inserted into the opening 25. With reference to FIG. 6, the first position of the operating member 310 may be a position in which the protruding portion 311 is inserted into the opening 25 and protrudes from the upper wall 22 of the piston 20 to push the elastic cover 200 such that the elastic cover 200 is deformed into the first state. With reference to FIG. 5, the second position of the operating member 310 may be a position in which the protruding portion 311 is spaced apart from the elastic cover 200 such that the elastic cover 200 is allowed to elastically return to the second state.

The cam protrusion 320 may be arranged at the second end portion 52 of the connecting rod 50. The cam protrusion 320 may protrude from the second end portion 52 of the connecting rod 50. The operating member 310 may be arranged between the upper wall 22 of the piston 20 and the cam protrusion 320. As described above, the second end portion 52 of the connecting rod 50 may pivot around the piston pin 21 according to the rotation of the crankshaft 60. When the piston 20 is placed at the bottom dead center BDC, the cam protrusion 320 may be located in a position retreated from the upper wall 22 of the piston 20 as illustrated in FIG. 5, and when the piston 20 is placed at the top dead center TDC, the cam protrusion 320 may be located in a position protruding towards the upper wall 22 of the piston 20 as illustrated in FIG. 6. When the piston 20 moves to the top dead center TDC, the cam protrusion 320 may protrude towards the upper wall 22 of the piston 20 and push and move the operating member 310 to the first position. When the piston 20 moves to the bottom dead center BDC, the cam protrusion 320 may be moved in a direction away from the upper wall 22 of the piston 20 and allow the operating member 310 to move to the second position.

When the piston 20 moves to the bottom dead center BDC, the operating member 310 may return from the first position to the second position by the restoring force of the elastic cover 200 from the first state to the second state. In other words, when the piston 20 moves from the top dead center TDC to the bottom dead center BDC, the cam protrusion 320 may pivot in a direction away from the operating member 310 and the force applied by the operating member 310 to push the elastic cover 200 may be removed. The elastic cover 200 may be restored into the second state from the first state by the elastic restoring force. The elastic cover 200 may push the operating member 310 located in the first position, e.g., the protruding portion 311. Due to this, the operating member 310 may return from the first position to the second position.

According to an embodiment of the disclosure, the cam mechanism 300 may further include an elastic member 330 applying an elastic force to the operating member 310 in a direction returning from the first position to the second position. The elastic member 330 may be implemented in various forms, such as a coil spring, a leaf spring, etc. For example, the elastic member 330 may be implemented by a leaf spring arranged between the upper wall 22 of the piston 20 and the operating member 310. The elastic member 330 may include a through portion 331 which is opened such that the protruding portion 311 passes through the through portion 331. When the piston 20 moves to the top dead center TDC, the elastic member 330 may be compressed between the operating member 310 moved to the first position and the upper wall 22 of the piston 20 and the elastic energy of the elastic member 330 may be accumulated. When the piston 20 moves to the bottom dead center BDC, the elastic member 330 may be restored to elastically push the operating member 310 towards the cam protrusion 320 such that the operating member 310 is returned to the second position. When the operating member 310 is not completely returned to the second position, the elastic cover 200 may not be restored into the second state. In such case, the effective suction volume of the compression chamber 30 may be reduced, which leads to decreased volume efficiency. According to the embodiment of the disclosure, by employing the elastic member 330, the operating member 310 may be completely returned to the second position, and as the elastic cover 200 is restored into the second state, a decrease in volume efficiency of the compression chamber 30 may be prevented.

According to an embodiment of the disclosure, the reciprocal compressor may further include an anti-wear member 210. The anti-wear member 210 may be arranged at a read rear side of the elastic cover 200, which is opposite to the upper wall 22 of the piston 20. The anti-wear member 210 may be in contact with the operating member 310 moved to the first position, e.g., the protruding portion 311 and prevent wear of the elastic cover 200. The anti-wear member 210 may be arranged on the rear side of the elastic cover 200. The anti-wear member 210 may be fixed to the rear side of the elastic cover 200. The anti-wear member 210 may be arranged between the upper wall 22 of the piston 20 and the elastic cover 200. The anti-wear member 210 may be, for example, a metal thin plate. The anti-wear member 210 may be formed of a material having elasticity. According to such configuration, a direct contact between the elastic cover 200 and the operating member 310 may be avoided to prevent wear of the elastic cover 200, which leads to improved durability of the reciprocal compressor.

Figure 7:
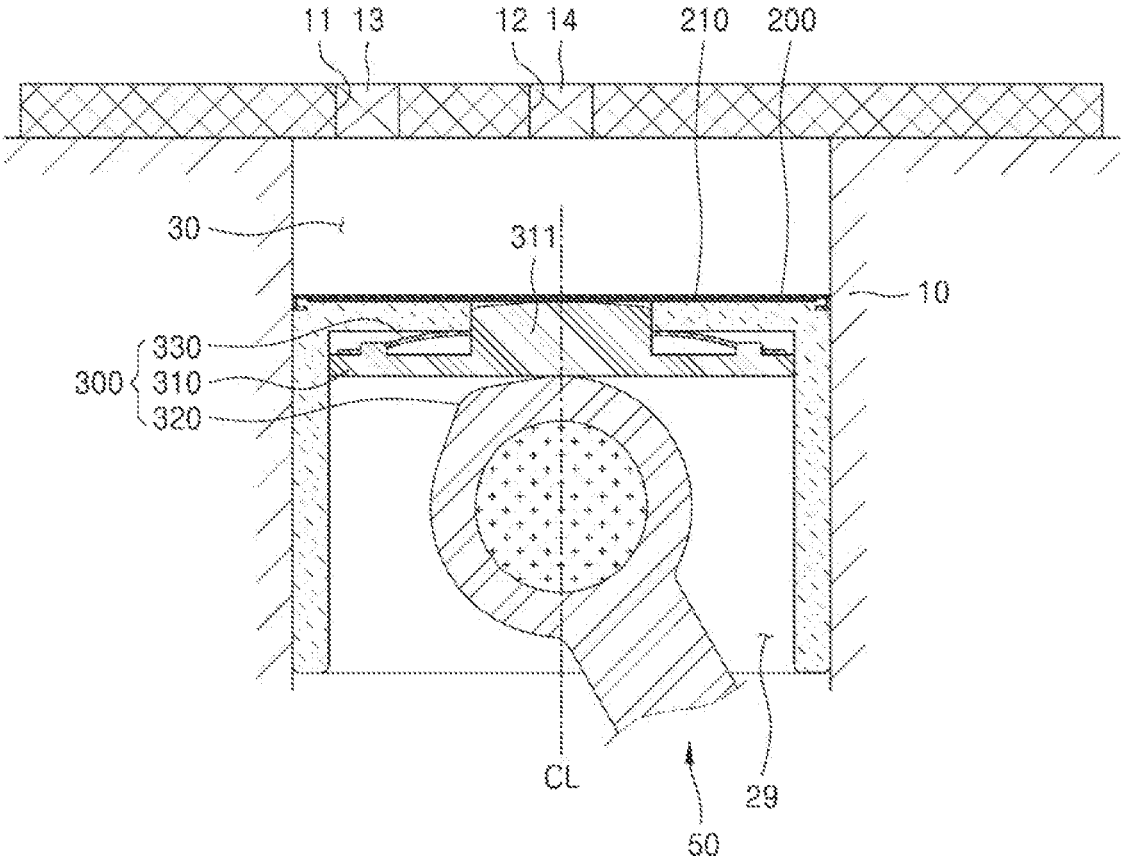
FIGS. 7, 8 and 9 are schematic cross-sectional views illustrating a suction process and a compression process according to an embodiment of the disclosure.
Figure 8:
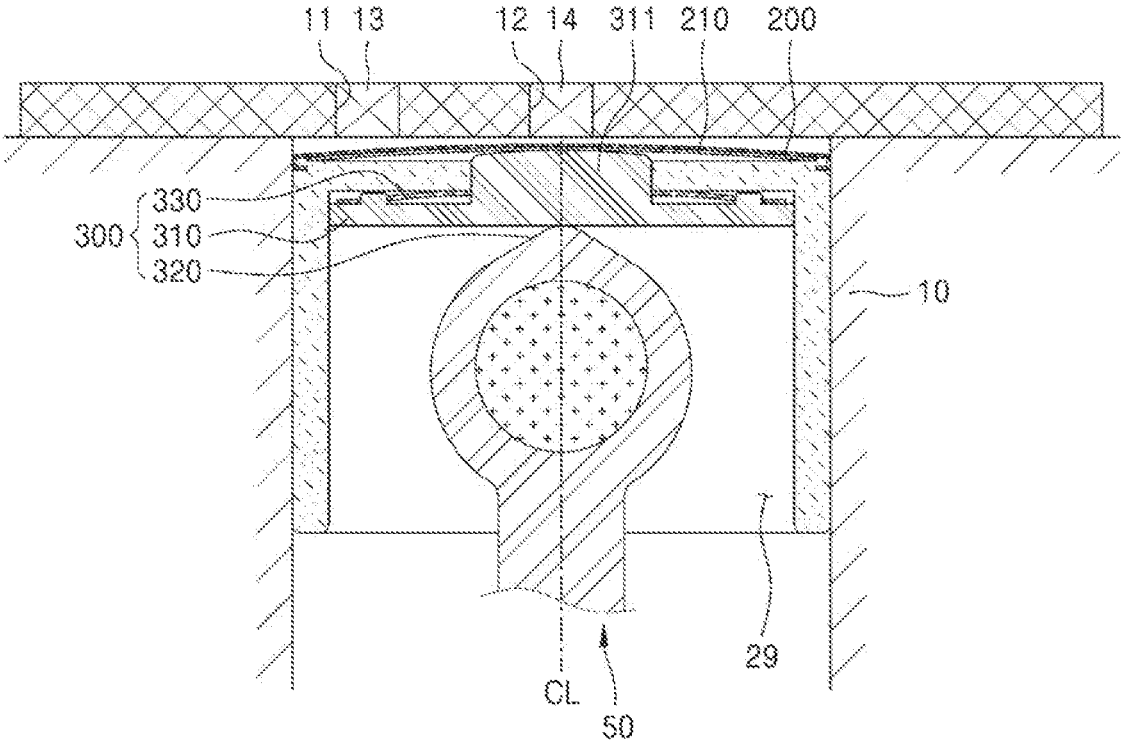
Figure 9:
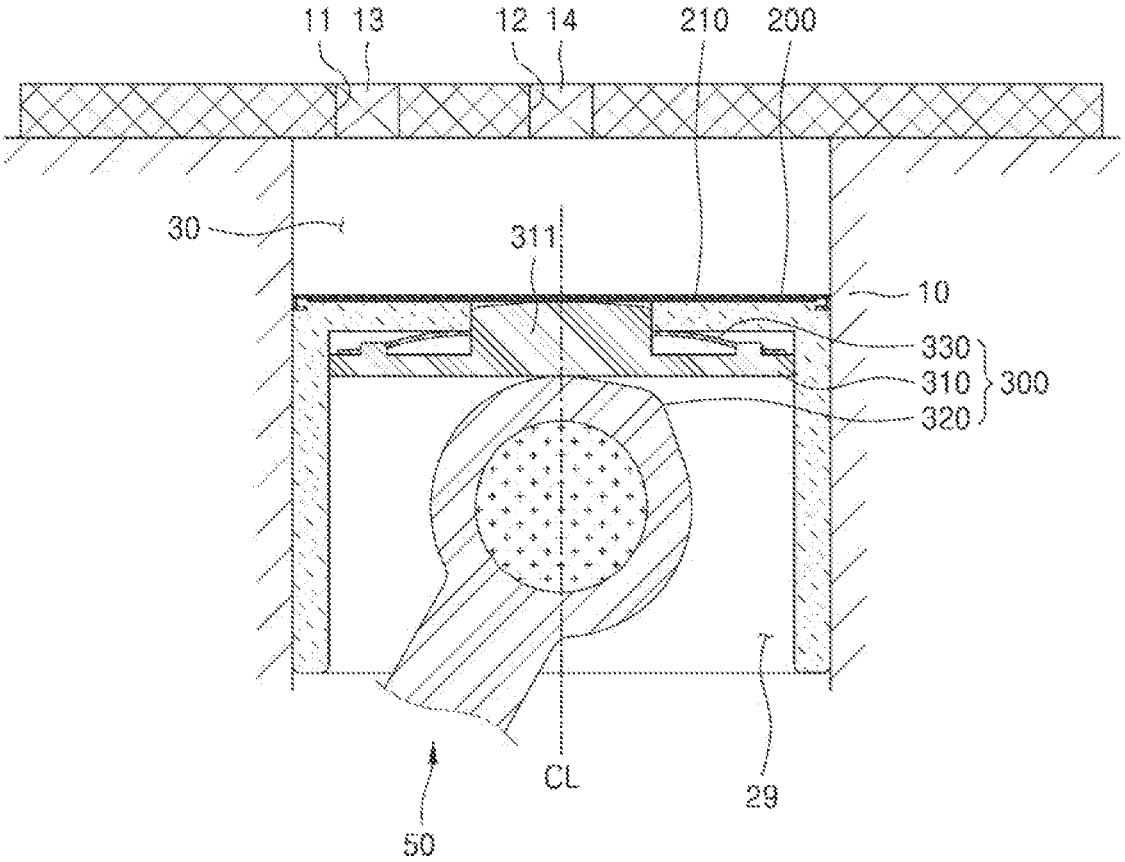

FIGS. 7 to 9 are schematic cross-sectional views illustrating a suction process and a compression process. With reference to FIGS. 7 to 9, the actions of the reciprocal compressor are described. With reference to FIG. 7, the piston 20 may be placed at the bottom dead center BDC. The cam protrusion 320 may be placed in a position inclined in the counterclockwise direction with respect to a center line CL. The operating member 310 may be placed in the second position by the elastic force of the elastic member 330. The elastic cover 200 may be in the second state where the elastic cover 200 is placed close to the upper wall 22 of the piston 20. In this state, when the crankshaft 60 rotates in the clockwise direction, the piston 20 may move up to the top dead center TDC. The compression process may be initiated. The inlet valve 13 may close the refrigerant inlet 11. As the volume of the compression chamber 30 is reduced, the refrigerant inside the compression chamber 30 may be compressed. The refrigerant outlet 12 may be opened by the outlet valve 14. The compressed refrigerant may be discharged through the refrigerant outlet 12.

The cam protrusion 320 may rotate in the clockwise direction and approach the center line CL. The cam protrusion 320 may push the operating member 310 towards the upper wall 22. Then, the elastic member 330 may be compressed, and the operating member 310 may approach towards the elastic cover 200. The protruding portion 311 of the operating member 310 may protrude outwards from the upper wall 22 through the opening 25 of the upper wall 22 and push the elastic cover 200, with the anti-wear member 210 arranged between the upper wall 22 and the elastic cover 200. The elastic cover 200 may partially be apart from the upper wall 22.

When the piston 20 arrives at the top dead center TDC as illustrated in FIG. 8, the cam protrusion 320 may be aligned with the center line CL, and the operating member 310 may be placed in the first position. The elastic cover 200 may be pushed by the operating member 310 and elastically deformed into the first state. The volume of the compression chamber 30 may be reduced proportionally to the deformation amount of the elastic cover 200. Accordingly, the volume of the compression chamber 30 when the piston 20 is placed at the top dead center TDC, i.e., the clearance volume may be reduced. The compression process may be completed.

When the crankshaft 60 continues to rotate in the clockwise direction, the piston 20 may move down towards the bottom dead center BDC. The suction process may be initiated. The refrigerant outlet 12 may be closed by the outlet valve 14. The inlet valve 13 may open the refrigerant inlet 11. As the volume of the compression chamber 30 is increased, the refrigerant may be sucked into the compression chamber 30 through the refrigerant inlet 11. The cam protrusion 320 may rotate in the clockwise direction and be away from the center line CL. The cam protrusion 320 may be moved in a direction apart from the operating member 310. As the elastic member 330 is elastically restored, the elastic member 330 may push the operating member 310 towards the cam protrusion 320. The operating member 310 may be placed apart from the elastic cover 200. The elastic cover 200 may be elastically restored and approach the upper wall 22. When the piston 20 arrives at the bottom dead center BDC as illustrated in FIG. 9, the cam protrusion 320 may be located in a position apart from the center line CL in the clockwise direction, and the operating member 310 may be placed in the second position. The elastic cover 200 may be elastically restored into the second state. The suction process may be completed.

Figure 10:
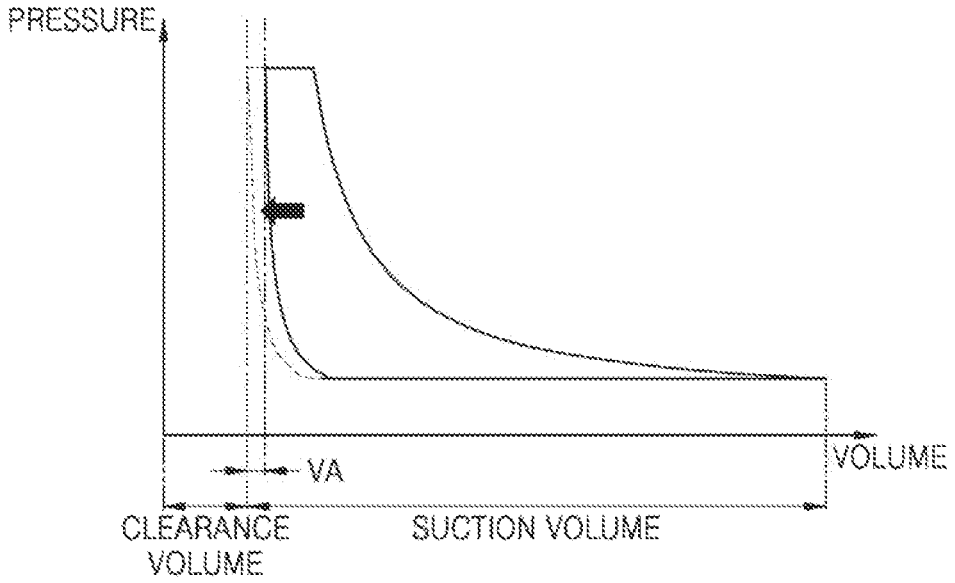
FIG. 10 is an example of a pressure-volume graph of a reciprocal compressor according to an embodiment of the disclosure.

When the crankshaft 60 continues to rotate in the clockwise direction, the reciprocal compressor may be switched from the state of FIG. 9 to the state of FIG. 8 and perform the compression process, and may be switched from the state of FIG. 8 to the state of FIG. 7 and perform the suction process. As such, the cam protrusion 320 may pivot in the clockwise direction and in the counterclockwise direction with respect to the center line CL such that the operating member 310 is elevated to deform the elastic cover 200 into the first state and the second state. According to this, as illustrated in FIG. 10, the suction volume may be increased by VA, compared to the case without the elastic cover 200 and the cam mechanism 300, and the volume efficiency of the reciprocal compressor may be enhanced. Even when the piston 20 contacts the upper structure of the cylinder 10, e.g., the inlet valve 13, the outlet valve 14, etc. due to the manufacturing error, etc., as the elastic cover 200 having elasticity is placed outside the upper wall 22 of the piston 20, the risk of damaging the upper structure of the cylinder 10 may be reduced. Moreover, as the elastic cover 200 having elasticity is placed outside the upper wall 22 of the piston 20, the top dead center TDC of the piston 20 may be designed to be at a higher position, and the clearance volume may be further reduced.

Figure 11:
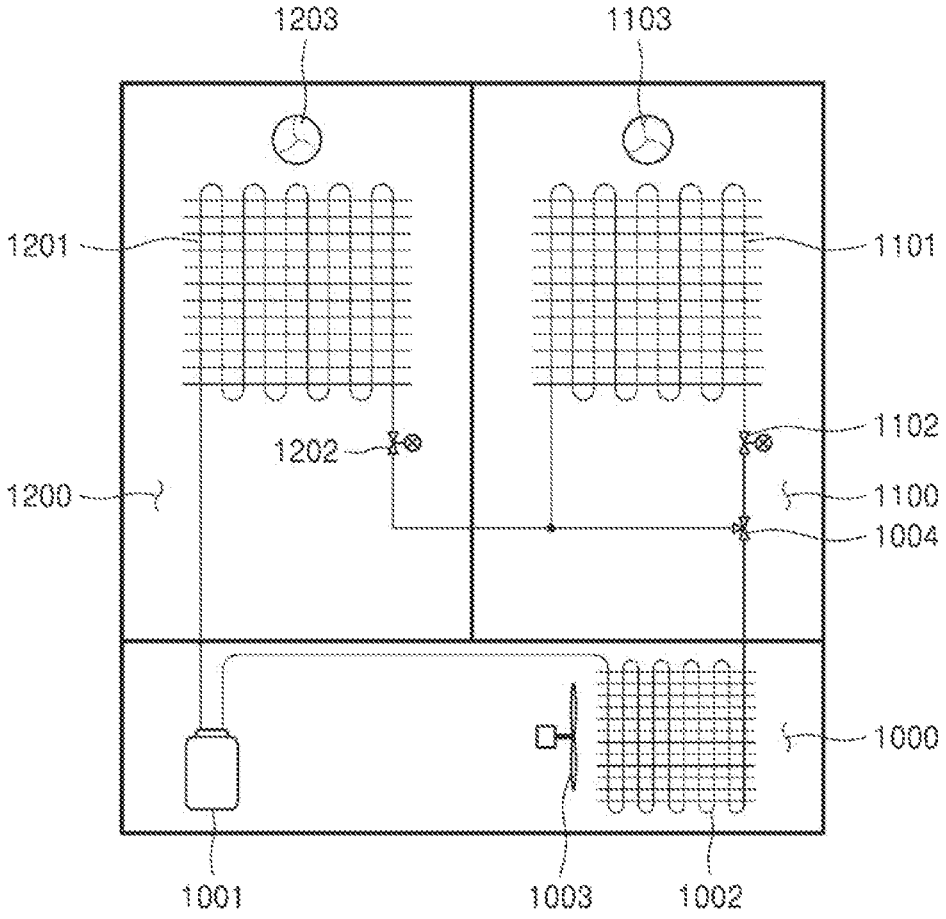
FIG. 11 is a schematic diagram of a refrigerator according to an embodiment of the disclosure.

FIG. 11 is a schematic diagram of an embodiment of a refrigerator employing the reciprocal compressor of the disclosure. With reference to FIG. 11, according to an embodiment of the disclosure, the refrigerator may include a storage chamber storing stocks, e.g., food, and a cooling device configured to cool the storage chamber. For example, the storage chamber may be divided into a first storage chamber 1100 and a second storage chamber 1200. For example, the first storage chamber 1100 may be a refrigerating compartment and the second storage chamber 1200 may be a freezing compartment. The cooling device may include a compressor 1001 configured to compress the refrigerant, a condenser 1002 configured to condense the refrigerant, an expansion valve depressurizing the refrigerant, and an evaporator configured to evaporate the refrigerant. For example, the evaporator may include a first evaporator 1101 and a second evaporator 1201. The first evaporator 1101 may cool the first storage chamber 1100. The second evaporator 1201 may cool the second storage chamber 1200. The expansion valve may include a first expansion valve 1102 and a second expansion valve 1202. The first expansion valve 1102 may be arranged between the condenser 1002 and the first evaporator 1101. The second expansion valve 1202 may be arranged between the condenser 1002 and the second evaporator 1201.

The compressor 1001 may be driven by electric energy supplied from an external power source. The compressor 1001 may be the reciprocal compressor described with reference to FIGS. 1 to 10. The compressor 1001 may compress a gaseous refrigerant flowing from the evaporator through the inlet tube 101 into a high-pressure gaseous refrigerant. The high-pressure gaseous refrigerant may be discharged from the compressor 1001 through the outlet tube 102, and delivered to the condenser 1002. The condenser 1002 may condense the high-pressure gaseous refrigerant into a high-pressure liquid refrigerant. A cooling fan 1003 may provide external air to the condenser 1002 such that a heat exchange is occurred between the refrigerant passing through the condenser 1002 and the external air. A refrigerant control valve 1004 may distribute the refrigerant from the condenser 1002 to the first evaporator 1101 and the second evaporator 1201. Each of the first expansion valve 1102 and the second expansion valve 1202 may depressurize the high-pressure liquid refrigerant provided from the condenser 1002 to the first evaporator 1101 and the second evaporator 1201. The refrigerant may undergo a liquid-gas phase change at the first evaporator 1101 and the second evaporator 1201, and by the heat exchange between the refrigerant and the air inside the first storage chamber 1100 and the second storage chamber 1200, the temperature inside the first and second storage chambers 1100 and 1200 may be decreased. A first air blower 1103 and a second air blower 1203 may circulate air to the first and second evaporators 1101 and 1201 and the first and second storage chambers 1100 and 1200. When the refrigerant undergoes the liquid-gas phase change at the evaporator, the heat inside the storage chamber may be absorbed, and the heat absorbed may be released to the external air during the gas-liquid phase change of the refrigerant at the condenser 1002. In this manner, the temperature inside the storage chamber may be lowered.

A reciprocal compressor according to an embodiment of the disclosure includes: a cylinder including a refrigerant inlet and a refrigerant outlet; a piston inside the cylinder and including an upper wall constituting a compression chamber, the piston including a lateral wall formed to extend from the upper wall; an elastic cover provided so that the upper wall of the piston is between the piston and the elastic cover; and a cam mechanism to deform the elastic cover into a first state in which the elastic cover is apart from the upper wall of the piston to reduce a volume of the compression chamber and to restore the elastic cover into a second state in which the elastic cover is closer to the upper wall of the piston than in the first state while the piston is moved to a top dead center and a bottom dead center.

According to an embodiment of the disclosure, the upper wall and the lateral wall of the piston may form an internal space, the upper wall of the piston may includes an opening, and the cam mechanism may be arranged in the internal space and is configured to deform the elastic cover through the opening.

According to an embodiment of the disclosure, the reciprocal compressor may include: a crankshaft; and a connecting rod including a first end portion and a second end portion respectively connected to the crankshaft and the piston, the connecting rod being configured to move the piston to the top dead center and the bottom dead center according to a rotation of the crankshaft, wherein the cam mechanism is driven by the connecting rod.

According to an embodiment of the disclosure, the cam mechanism may include: an operating member arranged in the internal space to move to a first position in which the elastic cover is pushed and deformed into the first state and to move to a second position in which the elastic cover is no longer pushed and is restored into the second state; and a cam protrusion formed to protrude from the second end portion of the connecting rod, push the operating member to the first position when the piston is moved to the top dead center and allow the operating member to be moved to the second position when the piston is moved to the bottom dead center.

According to an embodiment of the disclosure, the operating member may be returned from the first position to the second position by a restoring force of the elastic cover being restored from the first state to the second state.

According to an embodiment of the disclosure, the reciprocal compressor may further include an elastic member applying an elastic force to the operating member in a return direction from the first position to the second position.

According to an embodiment of the disclosure, the reciprocal compressor may further include an anti-wear member provided on a rear side of the elastic cover opposite to the upper wall of the piston and contactable with the operating member moving to the first position to prevent wear of the elastic cover.

According to an embodiment of the disclosure, the reciprocal compressor may further include: a coupling groove in a ring shape recessed into the lateral wall of the piston; and a coupling protrusion in a ring shape provided on an outer edge of the elastic cover and elastically insertable into the coupling groove.

According to an embodiment of the disclosure, the refrigerant outlet may be provided near a center of an upper wall of the cylinder.

A reciprocal compressor according to an embodiment of the disclosure includes: a cylinder including a refrigerant inlet and a refrigerant outlet; a piston inside the cylinder and including an upper wall with an opening and a lateral wall formed to extend from the upper wall of the piston and form an internal space together with the upper wall; and an elastic cover having elasticity and provided so that the upper wall of the piston is between the piston and the elastic cover.

According to an embodiment of the disclosure, the elastic cover may be deformable into a first state in which the elastic cover is apart from the upper wall to reduce a volume of a compression chamber and restorable into a second state in which the elastic cover is closer to the upper wall of the piston than in the first state. The reciprocal compressor may further include a cam mechanism in the internal space, to deform the elastic cover into the first state by accessing the elastic cover through the opening while the piston is moved to a top dead center, and allowing the elastic cover to be restored into the second state while the piston is moved to a bottom dead center.

According to an embodiment of the disclosure, the reciprocal compressor may include: a crankshaft; and a connecting rod including a first end portion and a second end portion respectively connected to the crankshaft and the piston, the connecting rod being configured to move the piston to the top dead center and the bottom dead center according to a rotation of the crankshaft. The cam mechanism may include: an operating member arranged in the internal space to move to a first position in which the elastic cover is pushed through the opening and deformed into the first state and to move to a second position in which the elastic cover is no longer pushed and is restored into the second state; a cam protrusion formed to protrude from the second end portion of the connecting rod, push the operating member to the first position when the piston is moved to the top dead center and allow the operating member to be moved to the second position when the piston is moved to the bottom dead center; and an elastic member to apply an elastic force to the operating member in a return direction from the first position to the second position.

According to an embodiment of the disclosure, the reciprocal compressor may include an anti-wear member provided on a rear side of the elastic cover opposite to the upper wall of the piston and contactable with the operating member moving to the first position.

According to an embodiment of the disclosure, the refrigerant outlet may be provided near a center of an upper wall of the cylinder.

According to an embodiment of the disclosure, the reciprocal compressor may further include: a coupling groove in a ring shape recessed into the lateral wall of the piston; and a coupling protrusion in a ring shape provided on an outer edge of the elastic cover and elastically insertable into the coupling groove.

According to an embodiment of the disclosure, a refrigerator includes: a storage chamber; and a cooling device configured to cool the storage chamber.

While the embodiments are described in detail, the scope of rights of the present disclosure is not limited thereto, and various modifications and improvements made by using the fundamental concept of the present disclosure defined in the following scope of claims may also be included in the scope of rights of the present disclosure.

What is claimed is:

1. A reciprocal compressor comprising:

a cylinder including a refrigerant inlet, a refrigerant outlet, and a cylinder upper wall;

a piston inside the cylinder and including a piston upper wall forming a compression chamber in the cylinder between the piston upper wall and the cylinder upper wall;

an elastic cover between the piston upper wall and the cylinder upper wall; and a cam mechanism including a cam protrusion configured to push and deform the elastic cover into a first state in which the elastic cover is apart from the piston upper wall to reduce a volume of the compression chamber when the piston is moved to a top dead center and to restore the elastic cover into a second state in which the elastic cover is closer to the piston upper wall than in the first state when the piston is moved to a bottom dead center.

2. The reciprocal compressor of claim 1, wherein the piston includes a lateral wall extending from the piston upper wall, the piston upper wall and the lateral wall form an internal space, the piston upper wall includes an opening, and the cam mechanism is arranged in the internal space and is configured to deform the elastic cover through the opening.

3. The reciprocal compressor of claim 2, comprising:

a crankshaft; and a connecting rod including a first end portion and a second end portion respectively connected to the crankshaft and the piston, the connecting rod being configured to move the piston to the top dead center and the bottom dead center according to a rotation of the crankshaft, wherein the cam mechanism is driven by the connecting rod.

4. The reciprocal compressor of claim 3, wherein the cam mechanism comprises:

an operating member arranged in the internal space to move to a first position in which the elastic cover is pushed and deformed into the first state and to move to a second position in which the elastic cover is no longer pushed and is restored into the second state; and the cam protrusion is formed to protrude from the second end portion of the connecting rod, to push the operating member to the first position when the piston is moved to the top dead center and to allow the operating member to be moved to the second position when the piston is moved to the bottom dead center.

5. The reciprocal compressor of claim 4, wherein the operating member is returned from the first position to the second position by a restoring force of the elastic cover being restored from the first state to the second state.

6. The reciprocal compressor of claim 4, further comprising an elastic member to apply an elastic force to the operating member in a return direction from the first position to the second position.

7. The reciprocal compressor of claim 4, further comprising an anti-wear member between the elastic cover and the piston upper wall and contactable with the operating member moving to the first position to prevent wear of the elastic cover.

8. The reciprocal compressor of claim 1, further comprising:

a lateral wall extending from the piston upper wall;

a coupling groove recessed into the lateral wall; and a coupling protrusion on an outer edge of the elastic cover and insertable into the coupling groove.

9. The reciprocal compressor of claim 1, wherein the refrigerant outlet is provided near a center of the cylinder upper wall.

10. A refrigerator comprising:

a storage chamber; and a cooling device configured to cool the storage chamber, wherein the cooling device includes the reciprocal compressor of claim 1.

11. A reciprocal compressor comprising:

a cylinder including a refrigerant inlet, a refrigerant outlet, and a cylinder upper wall;

a piston inside the cylinder and including:

a piston upper wall with an opening, and a lateral wall formed to extend from the piston upper wall and form an internal space together with the piston upper wall; and an elastic cover on the piston upper wall, having elasticity, and being deformable into first state in which the elastic cover is spaced apart from the piston upper wall to reduce a volume of a compression chamber.

12. The reciprocal compressor of claim 11, wherein the elastic cover is restorable into a second state in which the elastic cover is closer to the piston upper wall than in the first state, the reciprocal compressor further comprising:

a cam mechanism in the internal space, to deform the elastic cover into the first state by accessing the elastic cover through the opening while the piston is moved to a top dead center, and allowing the elastic cover to be restored into the second state while the piston is moved to a bottom dead center.

13. The reciprocal compressor of claim 12, further comprising:

a crankshaft; and a connecting rod including a first end portion and a second end portion respectively connected to the crankshaft and the piston, the connecting rod being configured to move the piston to the top dead center and the bottom dead center according to a rotation of the crankshaft, wherein the cam mechanism comprises:

an operating member arranged in the internal space to move to a first position in which the elastic cover is pushed and deformed into the first state and to move to a second position in which the elastic cover is no longer pushed and is restored into the second state;

a cam protrusion formed to protrude from the second end portion of the connecting rod, to push the operating member to the first position when the piston is moved to the top dead center and to allow the operating member to be moved to the second position when the piston is moved to the bottom dead center; and an elastic member to apply an elastic force to the operating member in a return direction from the first position to the second position.

14. The reciprocal compressor of claim 13, comprising an anti-wear member between the elastic cover and the piston upper wall and contactable with the operating member moving to the first position.

15. The reciprocal compressor of claim 11, wherein the refrigerant outlet is provided near a center of the cylinder upper wall.

16. The reciprocal compressor of claim 11, further comprising:

a coupling groove recessed into the lateral wall; and a coupling protrusion on an outer edge of the elastic cover and insertable into the coupling groove.

* * * * *